US006004358A

United States Patent [19]

Krüger et al.

[11] Patent Number: 6,004,358

[45] Date of Patent: Dec. 21, 1999

[54] BATCHWISE DYEING OF CELLULOSIC TEXTILE MATERIAL WITH INDIGO BY THE EXHAUST METHOD

[75] Inventors: Rudolf Krüger, Weisenheim; Gert Rainer Kühnel, Ludwigshafen; Georg Schnitzer, Nürnberg, all of Germany

[73] Assignee: BASF Aktiengesellschaft, Ludwigshafen, Germany

[21] Appl. No.: 08/891,707

[22] Filed: Jul. 9, 1997

[30] Foreign Application Priority Data

Jul. 16, 1996 [DE] Germany ..... 196 28 554

[51] Int. Cl.[6] ..... D06P 1/22; D06P 3/60

[52] U.S. Cl. ..... 8/653; 8/618; 8/918

[58] Field of Search ..... 8/653, 618, 918

[56] References Cited

U.S. PATENT DOCUMENTS 4,342,565 8/1982 Teague et al. ..... 8/532
5,514,187 5/1996 McFarland et al. ..... 8/401

FOREIGN PATENT DOCUMENTS 50 242 3/1939 United Kingdom .

OTHER PUBLICATIONS

Vat Dyestuffs and Vat Dyeing, M. R. Fox, John Wiley & Sons Inc p. 80, 88, 1948.

*Primary Examiner*—Margaret Einsmann
*Attorney, Agent, or Firm*—Oblon, Spivak, McClelland, Maier & Neustadt, P.C.

[57] ABSTRACT

The disclosure is a process for batchwise dyeing of cellulosic textile material with indigo by the exhaust method, which comprises applying the reduced indigo to the textile material from an aqueous dyeing liquor which includes a reductant, an alkali and additionally a further dissolved alkali metal salt in a concentration of from 200 to 350 g/l as electrolyte and whose pH has been set to 10.2–11.3, oxidizing the reduced indigo on the fiber back to the pigment while maintaining the high electrolyte concentration, and finishing the dyeing in a conventional manner.

13 Claims, No Drawings

BATCHWISE DYEING OF CELLULOSIC TEXTILE MATERIAL WITH INDIGO BY THE EXHAUST METHOD

The present invention relates to a novel process for batchwise dyeing of cellulosic textile material with indigo by the exhaust method.

The dyeing of cellulosic textile material with vat dyes is common knowledge. To confer the necessary substantivity on the water-insoluble vat dye, i.e. to fix the water-soluble vat dye on the textile material, it first has to be reduced (vatted) to its substantive water-soluble leuco form, before it is reoxidized back to the pigment dye.

Most leuco vat dyes have high affinity for fiber, giving high bath exhaustions of about 70 to 95%.

Leuco indigo, by contrast, gives a single-pass exhaustion onto the fiber of only about 10 to 20%. Owing to this low bath exhaustion, dyeing with indigo by batchwise exhaust methods (dyeing from the bath) is problematical.

It is therefore customary to dye with indigo continuously "in multiple passes". In the multiple-pass process, which incidentally can only be used for dyeing yarn as rope or as yarn sheet, but not for dyeing piece goods or packages, the vatted indigo is applied from a plurality (usually five or six) dyeing liquors of low dye concentration by repeated, brief (about 10–20 sec) dipping and squeezing and oxidization in the intermediary air passages. However, dyeing in passes is considered a makeshift exercise, since it requires uneconomically large dyeing machines and comparatively small dyelots are all but unmanageable.

A further problem of dyeing with indigo is that, owing to the low bath exhaustion, the resulting dyeings have poor rubfastness, since dye remaining in the dyebath settles out on the textile material in the unfixed state after oxidation.

It is an object of the present invention to remedy the aforementioned defects and to provide an advantageous process for dyeing with indigo not only cellulosic yarn but also cellulosic piece goods and made-up textiles in dark shades having satisfactory rubfastness.

We have found that this object is achieved by a process for batchwise dyeing of cellulosic textile material with indigo by the exhaust method, which comprises applying the reduced indigo to the textile material from an aqueous dyeing liquor which includes a reductant, an alkali and additionally a further dissolved alkali metal salt in a concentration of from 200 to 350 g/l as electrolyte and whose pH has been set to 10.2–11.3, oxidizing the reduced indigo on the fiber back to the pigment while maintaining the high electrolyte concentration, and finishing the dyeing in a conventional manner.

An essential feature of the process of the invention is that the dyeing is effected in the presence of extremely high electrolyte concentrations.

It is important to stress that the high electrolyte concentration is not only present at the time of application of the leuco indigo to the fiber, but also maintained until the reduced dye is reoxidized to the pigment, which can be done by forwarding the dyed textile material to the oxidation without prior rinsing (when the moist yarn obtained after removal of the liquor still contains sufficient quantities of electrolyte) or by effecting the oxidation directly in the exhausted dyebath after dyeing. Oxidation in the dyebath is especially attractive for the dyeing of made-up textiles in drum dyeing machines.

The electrolyte is suitably selected in particular from essentially neutral alkali metal salts which are sufficiently soluble in water in order that the desired concentration of dissolved electrolyte, generally from 200 to 350, preferably 250 to 330, particularly preferably about 300, g/l of liquor, may be set.

Neutral sodium salts such as sodium nitrate and, preferably, sodium chloride are particularly suitable. It is also possible, of course, to use mixtures with less soluble salts such as sodium sulfate or sodium phosphate.

It is a further essential feature of the process of the invention that the pH of the dyeing liquor be set at a level which is distinctly reduced compared with the customary vat dyeing pH of 13–13.5, namely generally at 10.2–11.3, preferably 10.8–11.1.

This can be advantageously accomplished, for example, by using sodium carbonate as alkali instead of the otherwise customary sodium hydroxide. However, it is also possible to buffer the sodium hydroxide in the course of the dyeing process with a buffer substance such as sodium bicarbonate; that is, to use a falling pH.

The measures of the invention make it possible to increase the substantivity of the indigo to such an extent that more than 95% of the vatted indigo goes onto the textile fiber.

The preferred reductant for the dyeing process of the invention is sodium dithionite.

The indigo can be added to the dyeing liquor as an aqueous pigment dispersion, which is preferably done continuously during the dyeing operation. Since in this case the indigo is not reduced until it is in the dyeing liquor, it is advisable here to employ reductant quantities of customarily from about 2 to 4 g/l of liquor.

However, the indigo is preferably added to the dyeing liquor in prereduced form. Examples of prereduced forms are the stock vats, i.e. the leuco indigo solutions prepared in an upstream vessel by reduction with sodium dithionite in the presence of sodium hydroxide at elevated temperature, and especially alkaline-aqueous leuco indigo solutions as obtained in the catalytic hydrogenation of indigo. These solutions generally have a leuco indigo content of from 10 to 35% by weight and an alkali content of from 2 to 10% by weight.

It will be readily understood that the reductant concentration in the dyeing liquor can be lowered if prereduced indigo is used, since only any indigo reoxidized by inadvertent air access has to be rereduced. Customary reductant quantities in this case therefore range from about 0.3 to 1.5 g/l of liquor.

The electrolyte and/or the indigo can be added to the dyeing liquor from the start, or—a little at a time or continuously—during the dyeing, until the desired electrolyte and indigo contents are attained. For dyeing made-up textiles in a drum dyeing machine, for example, the continuous metered addition of a leuco indigo solution is advisable. Furthermore, the desired pH need not be established until during the dyeing, for example by subsequent buffering of the initially charged, excessively strong basic liquor.

Finally, the dyeing liquor may also include further customary vat dyeing assistants such as dispersants, leveling agents and defoamers.

The dyeing process of the invention provides advantageous dyeing not only of cellulosic (especially cotton) yarn, preferably on package, but also of piece goods such as wovens and knits and made-up textiles, preferably in the jigger or in garment dyeing machines, for example drum dyeing machines. The dyeing preferably takes place from a standing bath, since the exhausted dyeing liquor can be re-used for dyeing after addition of dye.

The dyeing process of the invention can be carried out at room temperature or at up to about 80° C.; the range from 40 to 60° C. is preferred.

Customary dyeing times range from about 30 to 90 min.

The subsequent oxidation of the leuco indigo on the fiber to the pigment can be carried out directly in the exhausted dyeing liquor, for example when drum dyeing machines are used, by adding a mild oxidant such as sodium m-nitrobenzenesulfonate (generally 1–2 g/l) or 35% strength by weight aqueous hydrogen peroxide solution (generally 0.4–1 ml/l) to the exhausted dyeing liquor. The oxidation can be completed and accelerated by means of air access—alternatively by using compressed air—so that it is generally completed within 10–20 min.

In package dyeing, the oxidation is effected by means of an air stream over 10–20 min in general, after the liquor has been removed.

The dyeing can be finished in a conventional manner by rinsing and neutralizing and, if necessary, subsequent washing or soaping.

The process of the invention provides advantageous and reliable dyeing of cellulosic textile materials (yarn, piece goods and made-up textiles) with indigo in high quality by the exhaust method. The dyeings obtained are notable for their high rubfastness and levelness; even dark shades (generally from about 2 to 3% in strength) present no problem.

EXAMPLE 1

In a dyeing apparatus, 60 kg of ecru Nm 24/2 cotton yarn on package (600 g/package) are first bleached and then dyed with indigo in a liquor ratio of 16:1 using a flow rate of 30 $lkg^{-1}m^{-1}$ and liquor flow direction reversal every 3 min.

First the cotton yarn was bleached at 95° C. for 30 min with 960 l of an aqueous bleach liquor comprising

- 4 ml/l of 50% strength by weight aqueous hydrogen peroxide
- 4 ml/l of 38° Be sodium hydroxide solution and
- 1 g/l of a commercially available stabilizer based on EDTA.

After the bleach liquor had been dropped, the yarn was rinsed first with hot and then with cold water.

The bleached cotton yarn was then dyed for 60 min at 50° C. with 960 l of an aqueous dyeing liquor comprising

- 250 g/l of sodium chloride
- 3 g/l of anhydrous sodium carbonate
- 2 g/l of sodium dithionite (88% strength by weight) and
- 10 g/l of a 20% strength by weight alkaline-aqueous leuco indigo solution (4.8% by weight of sodium hydroxide, commercial product from BASF).

The dyeing liquor was then dropped, and the packages were aspirated for 20 min for complete oxidation.

Thereafter the packages were rinsed alkali-free with a cold water overflow for 5 min and then dried with hot air at 110° C.

This resulted in a level dyeing (viewed across the radius of the packages, equal depth of shade, i.e. pieces knitted from the inside, middle and outside package regions are identical in color) having a depth of shade of 3% (i.e., 94% of the indigo used is fixed) and excellent rubfastness (dry rating 4, wet rating 3 in test conforming to DIN 54021).

EXAMPLE 2

In a drum dyeing machine, 35 kg of pure cotton garments were introduced at 15 rpm into 475 l of a 60° C. aqueous liquor (liquor ratio 15:1) comprising

- 295 g/l of sodium chloride and
- 5 g/l of anhydrous sodium carbonate.

After addition of 2.4 kg of 88% strength by weight sodium dithionite (5 g/l),

- 15 l of indigo stock vat obtained by 1 hour reduction of 1.05 kg of indigo (≙3% by weight of indigo, based on the textile material) with 0.85 kg of 88% strength by weight sodium dithionite in 13 l of water at 60° C. in the presence of 1.9 l of 38° Be sodium hydroxide solution are metered in over 20 min at linear rate. On completion of the metering the dyeing was continued for a further 60 min at falling temperature.

The oxidation was then carried out in the exhausted dyeing liquor by addition of 475 g of sodium m-nitrobenzenesulfonate and air access.

The oxidation was complete after 20 min. The garments were then rinsed neutral with cold water. They were then hydroextracted by centrifuging and dried at 80° C.

The dyeing obtained was level, deep blue (2.8% of fixed indigo) and had excellent rubfastness (dry rating 3–4, wet rating 2–3).

The exhausted dye liquor was kept in readiness for a subsequent lot after making good the liquor loss of about 15%.

We claim:

1. A process for batchwise dyeing of cellulosic textile material with indigo by the exhaust method, which comprises applying a reduced indigo to a textile material from an aqueous dyeing liquor which comprises a reductant, an alkali and additionally a further dissolved neutral alkali metal salt in a concentration of from 200 to 350 g/l as electrolyte and whose pH has been set to 10.2–11.3, oxidizing said reduced indigo on a fiber to a pigment while maintaining said electrolyte concentration, and finishing said dyeing in a conventional manner wherein said reductant is sodium dithionite.

2. A process as claimed in claim 1, wherein the electrolyte used is sodium chloride.

3. A process as claimed in claim 1, wherein the alkali used is sodium carbonate or a mixture of sodium hydroxide and sodium bicarbonate.

4. The process of claim 1, wherein said pH of said dying liquor is from 10.8 to 11.1.

5. A process as claimed in claim 1, wherein the indigo is not reduced until in the dyeing liquor.

6. A process as claimed in claim 1, wherein prereduced indigo is added to the dyeing liquor.

7. A process as claimed in claim 1, wherein the textile material is separated from the dyeing liquor after the reduced indigo has gone on and the oxidation to the pigment is carried out directly without intermediary rinsing.

8. A process as claimed in claim 1, wherein the oxidation of the reduced indigo on the fiber is effected directly in the dyeing liquor.

9. A process as claimed in claim 1 for dyeing yarn, piece goods or made-up textiles.

10. A process as claimed in claim 1 for dyeing yarn on package.

11. The process of claim 1, wherein said neutral alkali metal salt is in a concentration of from 250 to 330 g/l.

12. The process of claim 1, wherein said neutral alkali metal salt is in a concentration of about 300 g/l.

13. The process of claim 1, wherein said neutral alkali metal salt is selected from the group consisting of sodium nitrate, sodium chloride, sodium sulfate, sodium phosphate and a mixture thereof.

* * * * *